United States Patent [19]

Peterson et al.

[11] Patent Number: 4,721,139

[45] Date of Patent: Jan. 26, 1988

[54] FEED ROLL FOR DEBARKING/DELIMBING APPARATUS

[75] Inventors: Arnold N. Peterson, Eugene; Larry A. Sprague, Dexter, both of Oreg.

[73] Assignee: Peterson Pacific Corporation, Pleasant Hill, Oreg.

[21] Appl. No.: 72,394

[22] Filed: Jul. 13, 1987

[51] Int. Cl.[4] ..... B27C 1/12; B27L 1/00

[52] U.S. Cl. ..... 144/246 C; 144/208 J; 144/341; 144/343; 144/2 Z; 198/692

[58] Field of Search ..... 198/692, 782; 144/208 R, 208 F, 208 J, 2 Z, 246 R, 246 C, 246 F, 340, 341, 343

[56] References Cited

U.S. PATENT DOCUMENTS

| | | | |
|---|---|---|---|
| 2,588,121 | 3/1952 | Johnston | 144/246 C |
| 2,612,987 | 10/1952 | Sjostrom | 198/692 |
| 3,687,271 | 8/1972 | Lindblom | 198/692 |
| 4,057,192 | 11/1977 | Smith | 144/246 C |
| 4,214,616 | 7/1980 | Brisson | 144/208 J |
| 4,510,981 | 4/1985 | Biller | 198/782 |

*Primary Examiner*—W. Donald Bray

*Attorney, Agent, or Firm*—Robert L. Harrington

[57] ABSTRACT

A feed roll for a log debarker or delimber wherein the roll is square-shaped in cross-section. Rows of gripping teeth are provided along each corner. The teeth are varied in height along the feed roll to form a sinusoidal or serpentine wave. Successive rows of teeth are offset so that the valleys of one row is aligned with the peaks of the succeeding row. The feed roll thus configured induces bouncing and side-to-side movement of a bundle of logs deposited thereon to induce spreading and side-by-side arrangement of the logs for processing.

5 Claims, 3 Drawing Figures

FEED ROLL FOR DEBARKING/DELIMBING APPARATUS

FIELD OF INVENTION

This invention relates to a feed roll used to feed logs or tree stems into and through an apparatus for debarking and/or delimbing the stems.

BACKGROUND OF INVENTION

With the demise of large trees for logging, the handling and processing of small logs or tree stems has become a major focus of the logging industry. One of the developments that emerged was the simultaneous processing of a plurality of such small tree stems. In a typical operation, a "bundle" of small tree stems, e.g. ranging from three inches in diameter to about eight inches in diameter, is picked up by a grapple and fed into the inlet of a debarker. The debarker unit is provided with a feed roll that is intended to rearrange the logs to a side-by-side arrangement for exposure to overhead and underneath flailing members.

Heretofore the feed roll was substantially cylindrical in configuration. Gravity action coupled with the rolling or feeding action was relied on to spread the bundled logs on the feed roll. However, such spreading of the small logs has not been consistently achieved. Obviously logs that pass through the debarker in a stacked arrangement will not be fully exposed to the flails and an entire side of log will still have the bark on it upon exiting the unit. Furthermore, the stacked logs have a much greater likelihood of jamming the unit. Accordingly there has been a need for improved log spreading means such as that provided by the present improved feed roll.

SUMMARY OF THE INVENTION

The preferred embodiment of the present invention is a feed roll that has an elongated rotatable base portion that is square in cross-section. Rows of gripping teeth are provided along each of the four edges or corners, the teeth facing the direction of rotation. The teeth are projected forward of the edge by an amount that increases and decreases to form a wave or sinusoidal configuration of "peaks" and "valleys" along the length of the roll. The wave formed by preceding and succeeding rows of teeth are offset so that the "peaks" of one edge are aligned with the "valleys" of a preceding and succeeding row of teeth and vice versa.

The advantage of the feed roll just described is that the square shape generates a bouncing action to the logs during rotation while the varying highs and lows of the gripping teeth generate a side-to-side swaying of the logs, both inducing a spreading of the logs along the feed roll.

The concept of the invention will be further appreciated by reference to the following detailed description with references to the drawings wherein.

Figure 1:
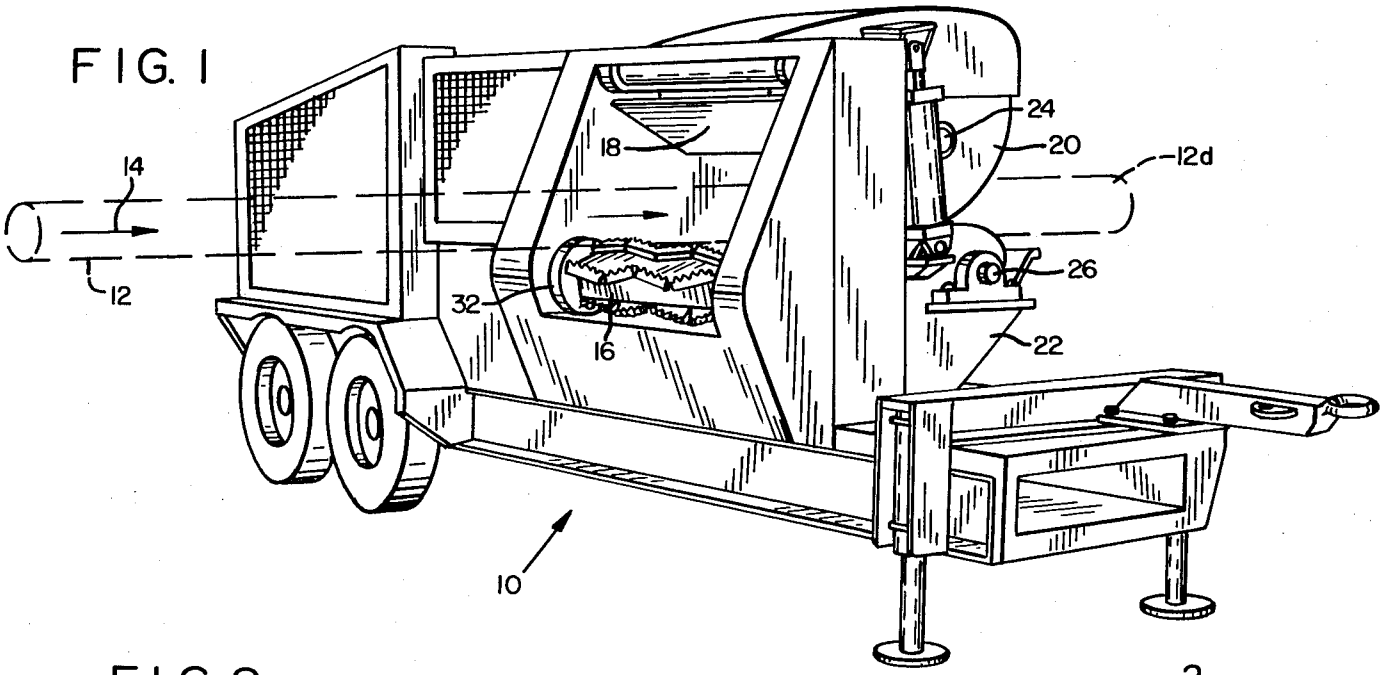
FIG. 1 is perspective view of a debarker unit incorporating the feed roll of the present invention.

Referring to the drawings, FIG. 1 illustrates a portable self-contained debarking apparatus 10. A log 12 is shown in dash lines and arrow 14 indicates the direction of movement of the log into and through the apparatus 10. Whereas a single log only is illustrated, the reader should understand that typically a plurality of the logs are positioned by an independently operated grapple on the feed roll 16 and directed into the deflecting plate 18 at the entry of the debarking station. Rotating debarking flails inside the unit in the path of the logs remove the bark.

The debarking flails are not shown. However, the upper and lower shrouds 20 and 22 and the pivots indicated at 24 and 26 indicate this operation taking place behind the deflecting plate 18. The bark is directed down and out of the apparatus and the debarked log 12*d* emerges from the apparatus as indicated.

The above operation is important only for an understanding that the roller 16 is the primary control of the apparatus for arranging and conveying the logs into and through the apparatus. The reader should appreciate, however, that a log handling machine is a factor in the start-up feeding of the logs onto the feed roll and into engagement with deflection plate 18. Also, the flailing members within the apparatus, rotating against the log in the direction of log movement, assists in a continuation of the feeding of the logs through the debarking apparatus. However, it is the design of the feed roll and the resultant operation thereof that is the subject of the present invention and the remainder of this description will be directed to the specifics of the feed roll 16.

Figure 2:
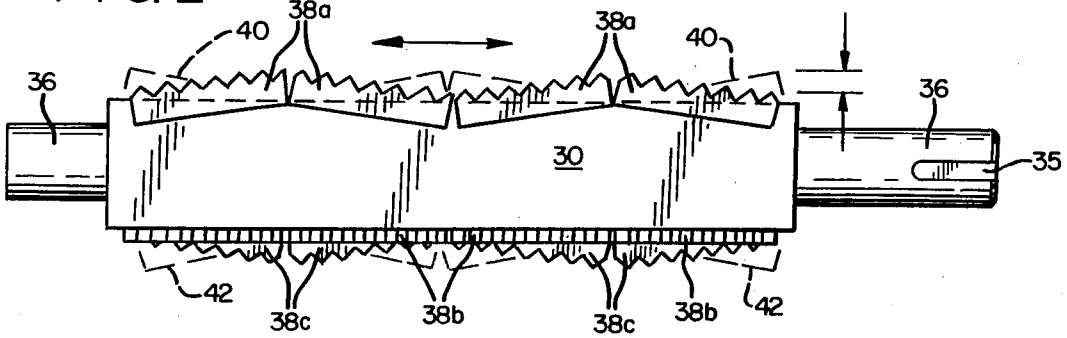
FIG. 2 is a side view of the feed roll of FIG. 1.
Figure 3:
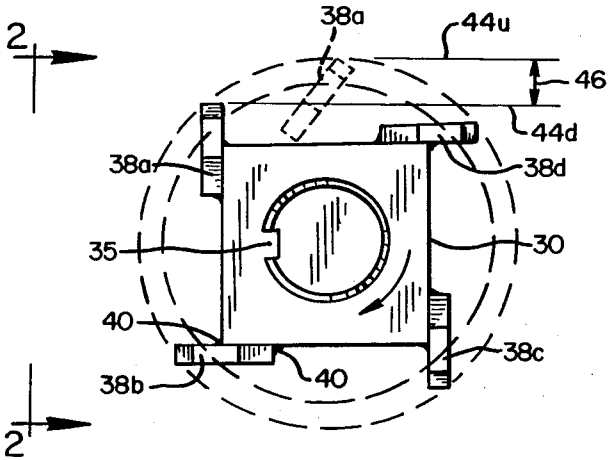
FIG. 3 is an end view of the feed roll of FIG. 2.

Reference is now made to FIGS. 2 and 3 of the drawings. There are three major components making up the feed roll 16 of the invention. There is a base member 30 that is square in cross-section as indicated in FIG. 3 and which extends substantially the full width of the inlet; i.e., between housing brackets 32 in FIG. 1 (only one of which is illustrated). Rigidly attached to each end of the base member 30 are spindles 36. In actuality the spindles and base member are machined from the same steel shaft. Spindles 36 are journaled inside the housing bracket 32 which contains bearings and one of which contains a drive mechanism. Keyway 35 on the spindle at one end (the right end as seen in FIG. 2) engages the drive mechanism to impart rotation to the spindle and thus to the base member 30.

Fastened along each of the four longitudinal edges or corners of the base member 30 are successive teeth section 38, each provided with a plurality of teeth and forming a row of teeth substantially continuously along each edge. Note that FIG. 2 is a side view as if taken on section lines 2—2 of FIG. 3. Three of the rows of teeth are thus shown; i.e., rows 38*a*, 38*b*, and 38*c*. Row 38*d* is hidden behind row 38*a*. For simplicity of illustration and understanding, four of such sections 38 are shown forming each of the rows 38*a*, *b*, *c*, and *d*. Likely however, the number of such sections will be more than that illustrated. The four sections are rigidly fastened to the base member 30, e.g. by welding.

The teeth sections 38 as indicated in the Summary of the Invention are arranged in a serpentine configuration. Referring to row 38*a* of FIG. 2, the first section has the left-hand tooth projected just above the corner of the base member 30 with succeeding teeth increasingly projected outward therefrom to a maximum height at the right-hand tooth of that section. The next section has its left-hand tooth at substantially the same height; i.e., at maximum projection, with succeeding teeth decreasing therefrom to a point just outwardly of the corner of the base member 30. This sequence is repeated for the third and fourth sections (and so on if more sections are involved).

Note now that row 38c (skipping the intermediate row 38b) is arranged in the same manner as row 38a. Rows 38b and 38d form a similar serpentine configuration except that the incline and decline is reversed. Note the dash line 40 and 42 which represent the comparable serpentine configuration of the rows 38b and 38d if the feed roll were shifted 90 degrees from the position illustrated in FIG. 2.

In an actual feed roll constructed in accordance with this invention, the base member 30 was 41 inches long with a square cross-section of 4 inches to a side. The idler spindle (the non keyed spindle as shown on the left side in FIG. 2) was about 3 inches long while the driven spindle was about 6 inches long. Both were about 2½ inches in diameter. The spindles 36 and base member 30 were formed from a solid square steel shaft with the spindles turned down to the desired diameter.

The tooth sections 38 were each 5 inches in length and contained seven teeth along one edge. Eight of such sections were attached to the base member along each corner and substantially spanned the 41 inch length of the base member. (A ½-inch gap was left open at each end of the base member.)

The teeth sections projected out from the base edge or corner from a minimum distance of ¼ inch at the valley position of the wave formation to 1 inch maximum at the peak. Thus, over a 5-inch length, the teeth projections varied from minimum to maximum by ¾ inch. Considering the entire length of the row of teeth, the height changed from maximum to minimum and back to maximum (or vice versa) a total of four times. As explained above, the arrangement of teeth from high to low and back to high was reversed for alternate corners of the base member; i.e., from low to high and back to low.

The operation of the apparatus will now be explained.

It will be understood that once the log bundle is inserted by the grapple under the deflecting plate 18, the weight of the logs are borne by the feed roll 16. The feed roll 16 is driven at a speed of about 80 revolutions per minute typical for feed rolls of the prior apparatus.

Once the logs are released by the grapple, they will have some tendency to spread out on their own. This is greatly amplified, however, by the action of the feed roll 16 as will now be explained.

Two types of action are simutaneously occurring due to the feed roll configuration. The first action results from the square shaped configuration. Refer to FIG. 3 wherein the bottom of a log is assumed to be resting on the feed roll 16 indicated at an upper and lower positions by dash lines 44u and 44d. The feed roll 16 as shown in solid lines will support the log at the lower position 44d. As the feed roll 16 is rotated, the teeth section 38a rotates to a position shown in dotted lines which supports the log at the high position 44u. The difference in height is indicated by the arrows 46 (in the specific example described above, this difference is about an inch). Ignoring at this point the varying height of the gripping teeth of sections 38 due to the serpentine configuration, simply by reason of the square shape of the feed roll, the bundle of logs deposited on the feed roll will be rapidly bounced up and down to induce spreading of the logs.

Now with reference to FIG. 2, it will be observed that a height differential is established lengthwise along the feed roll between the peaks and valleys of the teeth projections. (In the specific example, this height differential is about ¾ of an inch.) When the logs are positioned on one of the rows of teeth, they are gravitationally laterally urged toward the valleys. As the next row of teeth roll up and into engagement with the logs, the lateral urging will be reversed because the logs that have moved into the valleys of the prior row of teeth are positioned now on the peaks of this succeeding row. This action is repeated ad infinitum to generate a side-to-side swaying back and forth of the logs.

The two actions in concert thus produce a bouncing and side-to-side action of the logs with the resultant affect that the stacked logs are shifted into a side-by-side arrangement.

Those familiar with the art and skilled in log processing design will likely conceive of numerous variations to the concept of the invention as embodied in the specific apparatus disclosed. The invention is not however limited to the disclosed apparatus, but is encompassed by the claims appended hereto.

We claim:

1. In a log processing apparatus having a processing station with an inlet and outlet to the processing station, a feed roll for receiving a bundle of logs and providing the additional function of spreading the logs from a stacked to a side-by-side arrangement for processing, said feed roll comprising; a multiple-sided base member having corners formed at the side junctures, spindles projected from each end of the base member and rotatably mounting the feed roll at a position adjacent the inlet of the apparatus for driven rotation of the roll to thereby induce movement of logs placed thereon into the processing station.

2. In a log processing apparatus as defined in claim 1, said feed roll having a row of gripping teeth provided along certain of the corners of the base member and projecting outwardly of the corner whereby the teeth engage the logs to induce the feeding movement thereof, each said row of teeth formed into a serpentine configuration with succeeding teeth along the row gradually increasing and then decreasing in height relative to the corner to provide successive peaks and valleys along the row, and at least one of the rows offset relative to another of the rows whereby the peaks of said one row is aligned with the valleys of said another row.

3. In a log processing apparatus as defined in claim 2, each said row of gripping teeth provided by teeth sections, certain of said teeth sections oriented to increase the projection of successive teeth along the sections relative to the base member corner from a minimum height to a maximum height, and others of said teeth sections interspersed between said certain sections and oriented to decrease the projection of the successive teeth along the sections.

4. In a log processing apparatus as defined in claim 3, each row of teeth providing at least two cycles of peaks and valleys along the feed bar length.

5. In a log processing apparatus as defined in claim 4, said base member having four sides forming four corners, a serpentine configured row of teeth provided at each corner, and alternate ones of said rows of teeth being offset relative to each other row of teeth to induce both bouncing and swaying action of logs deposited thereon.

* * * * *